US005859633A

United States Patent [19]

Kim

[11] Patent Number: 5,859,633

[45] Date of Patent: Jan. 12, 1999

[54] GRADATION DRIVING CIRCUIT OF LIQUID CRYSTAL DISPLAY

[75] Inventor: Jun-Hee Kim, Seoul, Rep. of Korea

[73] Assignee: LG Electronics Inc., Seoul, Rep. of Korea

[21] Appl. No.: 803,471

[22] Filed: Feb. 20, 1997

[30] Foreign Application Priority Data

Mar. 26, 1996 [KR] Rep. of Korea ..... 1996-8391

[51] Int. Cl.[6] ..... G09G 5/00

[52] U.S. Cl. ..... 345/211; 345/89

[58] Field of Search ..... 345/89, 87, 88, 345/147, 148, 98, 99, 100, 211, 212, 213

[56] References Cited

U.S. PATENT DOCUMENTS 5,122,792 6/1992 Stewart ..... 345/148
5,196,738 3/1993 Takahara et al. ..... 345/89
5,363,118 11/1994 Okumura ..... 345/89
5,534,885 7/1996 Saitoh .

OTHER PUBLICATIONS

The Operational Amplifier, Chapter 6, pp. 188–211.

*Primary Examiner*—Xiao Wu
*Attorney, Agent, or Firm*—Finnegan, Henderson, Farabow, Garrett & Dunner, L.L.P.

[57] ABSTRACT

A gradation driving circuit is provided that outputs gamma-corrected gray scale voltages. First and second multiplexors select first and second source voltages, respectively, in response to input data. The first source voltage is scaled by an appropriate factor corresponding to a required amount of gamma correction. The scaling factor is selected based on an additional output from the second multiplexor. The scaled first voltage is then subtracted from the second source voltage and the difference is output as the gray scale voltage. Alternatively, the gray scale voltage can be obtained by adding the first scaled source voltage and the second source voltage.

16 Claims, 6 Drawing Sheets

14
24
25
R'f
R
52
27
26
Vo1
29
Rf
Vref2
Vref1
R0
R1
R7
SW0
SW'1
SW'7
12
V8
V16
V24
V32
V40
V48
V56
V64
V0
V7
V6
V5
V4
V3
V2
V1
11
50
51
13
MUX2
MUX1
01
02
03
04
05
06
07
08
D5
D4
D3
D2
D1
D0

GRADATION DRIVING CIRCUIT OF LIQUID CRYSTAL DISPLAY

BACKGROUND OF THE INVENTION

1. Field of the Invention

The present invention relates to a thin film transistor (TFT) liquid crystal display (LCD) and, more particularly to a gradation driving circuit which can output a large number of gray scale voltages in response to a minimum number of input voltages.

2. Discussion of Related Art

Generally, the TFT LCD module is a planar display, that is lightweight, thin, consumes little power, and has high contrast. Typically, the TFT LCD includes a back light which emits light through a matrix of pixels to the user. Each pixel includes three subpixels and associated color filters corresponding to the colors red, green and blue. Thus, for example, if a pixel were to emit blue light, the two sub pixels corresponding to the green and red filters are rendered opaque, while the sub pixel corresponding to the blue filter is made transparent. The human eye integrates light transmitted through the subpixels so that by selectively combining various combinations of the red, green and blue light, additional colors can be generated. Even more colors, however, can be displayed by further combining gray scales or gradations of each of the primary colors red, green and blue.

The gray scales are generated by supplying gray scale voltages to the individual sub pixels of the LCD, thereby causing the subpixels to have varying degrees of transmissivity. These gray scale voltages are output from a driver circuit capable of generating the requisite number of gray scale voltages at the appropriate levels.

TFT LCDs are commonly used in both audio video (A/V) and office automation (O/A) applications to display up to 512 colors using a 6-bit digital driver. As computers are increasingly being used in multi-media applications (transmission of both video and communication data) a wider range of colors are required. It has therefore been proposed that TFT displays generate up to 260,000 different colors by creating 64 gradations (or gray scales) for each of the primary colors red, green and blue. Although analog drivers, such as resistor ladders, can be used in certain A/V applications, a suitable driver for generating such a large number of colors in a high resolution O/A application has been difficult to realize.

A conventional gradation driving circuit of a liquid crystal display will be described below.

As illustrated in FIG. 1, the conventional gradation driving circuit includes a voltage source output part 1, a voltage source selection part 2 and an adder 3. The voltage source output part 1 outputs a plurality of different voltages. The voltage source selection part 2 selects the voltage source corresponding to the input data. The adder 3 receives and adds each voltage source output from the voltage source selection part 2, and outputs an appropriate gray scale voltage.

As shown in FIG. 2, the conventional output level selection circuit includes a plurality of source voltages $V_0$ to $V_n$ (namely $V_0$, $V_1$, $V_2$, $V_3$, $V_4$, $V_8$, $V_{16}$) each coupled to a respective one of a plurality of switches $SW_0$ to $SW_n$ through one of resistors 24. Adder 3 is further provided to add various voltages supplied through selected ones of switches $SW_0$ to $SW_n$. Adder 3 can be realized with an operational amplifier 20 having its inverting input and output coupled to one another through resistor 22 and its non-inverting input coupled to ground. The voltage sum output of adder 2 corresponds to the gray scale voltage.

The operation of the conventional output level selection circuit will now be described. By way of example, if a gradation voltage corresponding to the 13th gray scale is to be selected, input data of 1011 (base 2), which equals 13 (base 10), is supplied to voltage selection part 2. The input data causes switches $SW_1$, $SW_4$, and $SW_8$ to close, thereby coupling source voltages $V_1$, $V_4$, and $V_8$, an input of adder 3. The 13th gray scale voltage is thus output as the sum of source voltages $V_1$, $V_4$, and $V_8$.

FIG. 3 is a graph illustrating transmissivity of the LCD pixel (sub pixel) (T-V) as a function of applied gray scale voltage. As further shown in FIG. 3, due to the optical properties of the liquid crystal material, the relationship between applied gray scale voltage and transmissivity is not 15 linear, commonly referred to as the "gamma". Thus, the difference in potential between voltage $V_0$ and $V_8$ is not the same as the difference between voltage $V_8$ and $V_{16}$, for example. Accordingly, the interval between adjacent source voltages in the range of $V_0$ to $V_8$ is different than the interval between adjacent source voltages in the range of $V_8$ to $V_{16}$.

The conventional gradation driving circuit, however, outputs driving voltages that are spaced by the same interval across the range of $V_0$ to $V_{16}$. Thus, the conventional driving circuit does not compensate for the non-linearity of the transmissivity vs. gray scale voltage curve shown in FIG. 3, and does not provide "gamma correction".

SUMMARY OF THE INVENTION

Accordingly, the present invention is directed to a gradation driving circuit of a liquid crystal display that substantially obviates one or more of the problems due to limitations and disadvantages of the related art.

An object of the present invention is to provide a gradation driving circuit of a liquid crystal display capable of displaying gamma-corrected gray-scale voltages with only a limited number of source voltages and calculation and scaling circuits utilizing an operational amplifier or opamp.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the anpended drawings.

To achieve these and other advantages and in accordance with the purpose of the present invention, as embodied and broadly described, the gradation driving circuit of a liquid crystal display includes: first and second multiplexers each for selecting a source voltage with respect to m-bit input data; a scaling circuit for scaling or adjusting either up or down the source voltages selected by the first and second multiplexers; and a subtraction part for calculating the scaled output of the scaling part and the output of the second multiplexer, and then outputting the calculated result as a gray-scale voltage.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings. Wherever possible, the same reference numbers will be used throughout the drawings to refer to the same or like parts.

Figure 1:
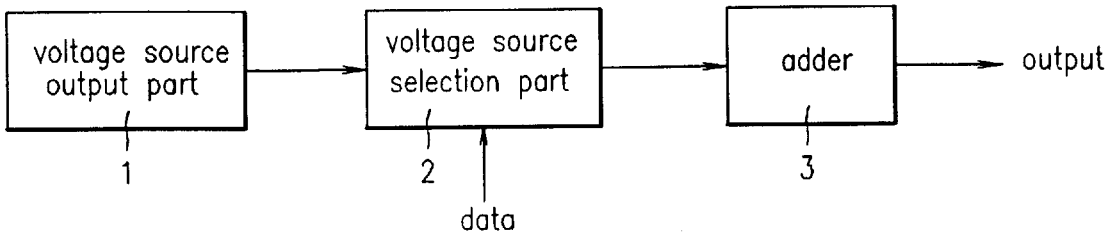
FIG.1 prior art
FIG. 1 is a block diagram of a conventional uradation driving circuit of a liquid crystal display.
Figure 2:
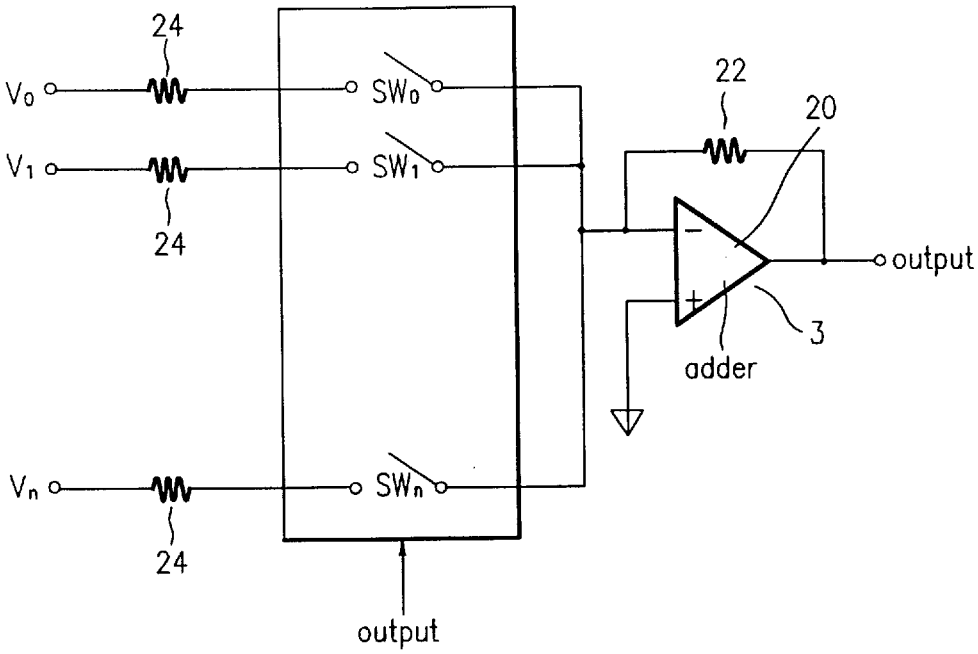
FIG.2 prior art
FIG. 2 illustrates the conventional gradation driving circuit in greater detail.
Figure 3:
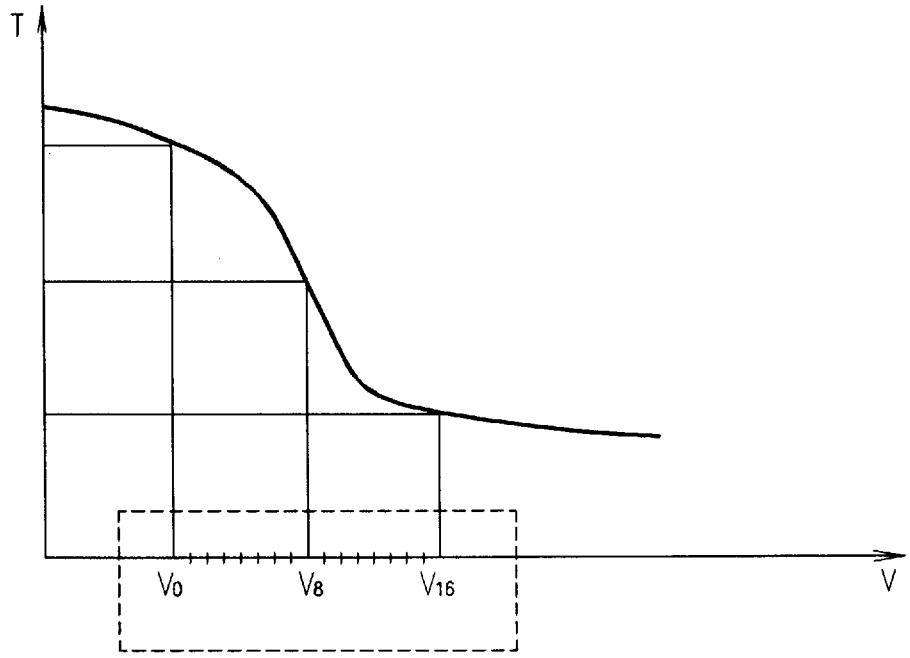
FIG. 3 illustrates a T-V graph of a liquid crystal display pixel.
Figure 4:
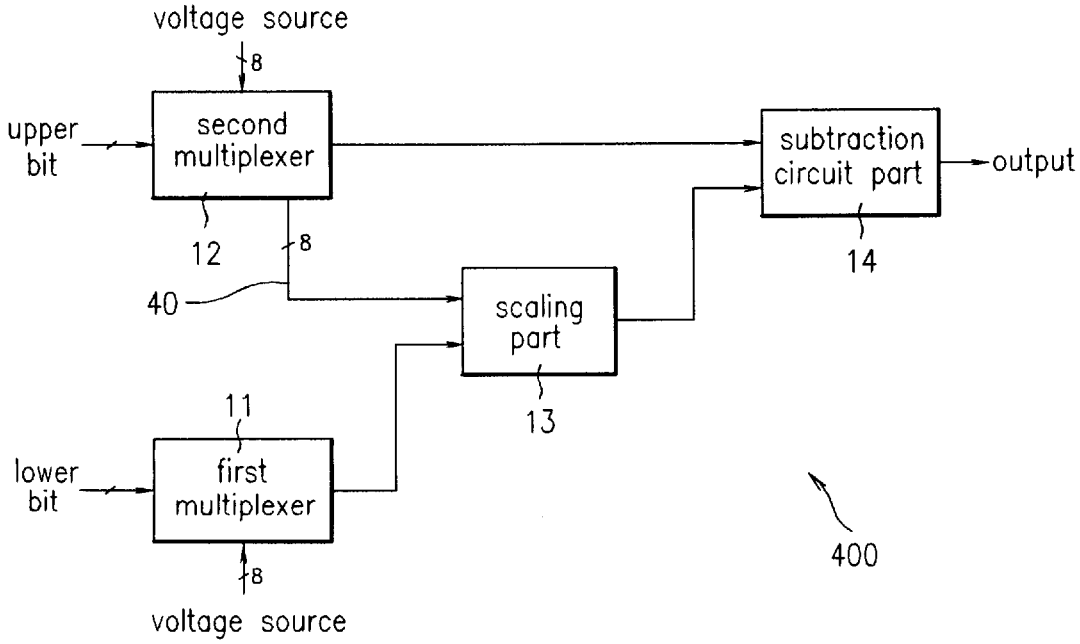
FIG. 4 is a block diagram of a gradation driving circuit of a liquid crystal display in accordance with the present invention.

FIG. 4 is a functional block diagram of a gradation driving circuit consistent with the present invention. Gradation driving circuit 400 typically receives 6 bits designating a particular gray scale voltage output. The upper three bits are supplied to second multiplexer 12 for selecting one of 8 source voltages $V_8$, $V_{16}$, $V_{24}$, $V_{32}$, $V_{40}$, $V_{48}$, $V_{56}$, and $V_{64}$, and the lower three bits are input to first multiplexer 11 for selecting one of source voltages $V_0$ to $V_7$. Further, one of output lines 40 is driven high and supplied to scaling part 13. The source voltage selected by the first multiplexer are input to scaling part 13, which scales or multiplies the selected one of source voltages $V_0$ to $V_7$ by an appropriate gamma-corrected scaling factor. The output of scaling part 13 along with the source voltage selected by second multiplexer 12 are supplied to a combining circuit, in this case subtraction part 14, which arithmetically combines, by subtraction, the scaled source voltage selected by first multiplexer 11 from the source voltage selected from second multiplexer 12. As a result, a gamma correct gray scale voltage is output to the sub-pixel (or pixel). As discussed in detail below, however, the combining circuit can include an adder circuit instead of a substraction circuit.

Figure 5:
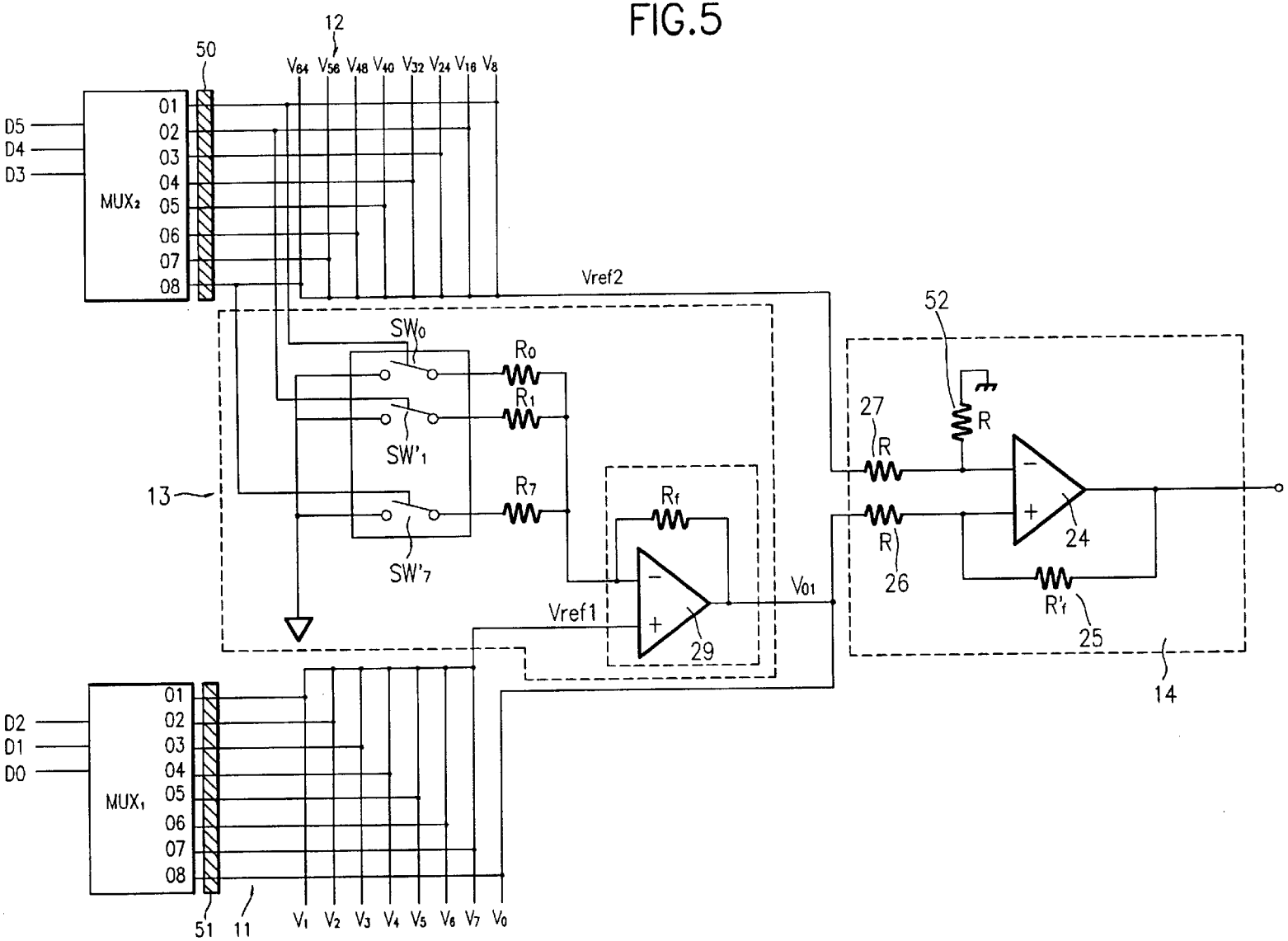
FIG. 5 is a detailed diagram of the gradation driving circuit of a liquid crystal display of the invention.

FIG. 5 illustrates gradation driving circuit 400 in greater detail. Second multiplexer 12 receives upper input data bits D3–D5, to thereby drive high one of outputs 01 to 08. The selected output is coupled to a level shifter 50, which generates an appropriate potential to turn on a corresponding pass transistor (not shown) to supply the desired one of source voltages $V_8$ to $V_{64}$, Vref2, to scaling part or circuit 13.

Meanwhile, first multiplexer 11 receives lower input data bits D0–D2 to drive a corresponding one of output lines 01–08. Level shifter 51 adjusts the voltage on the selected output line to an appropriate value to drive a corresponding pass transistor (not shown), thereby coupling a corresponding one of source voltages $V_0$ to $V_7$ as voltage Vref1 to scaling part 13.

It has been determined that scaling is only necessary for certain ranges of gray scale voltages. Thus, only selected output lines of MUX2 of second multiplexer 12 are coupled to switches in the scaling part. In particular, typically only output lines 01, 02 and 08 are coupled to switches in SW'0, SW'1 and SW'7 to facilitate scaling, as discussed in greater detail below. The remaining output lines of MUX2 of second multiplexer 12 are not coupled to scaling part 13. Accordingly, no scaling is performed and the actual source voltage output from first multiplexer 11 is subtracted from the selected source voltage output from second multiplexer 12.

Assuming that, in scaling part 13, the selected output line of MUX2 of second multiplexer 12 drives one of switches SW'0, SW'1 and SW'7, the selected output line of MUX2 is thus coupled to the inverting input of opamp 29 through a corresponding one of resistors R0 to R7. Additionally, the selected source voltage from first multiplexer 11 is supplied to the non-inverting input of opamp 29. Since opamp 29 is configured as a multiplier circuit, the potential V01 output from opamp 29 depends on to the selected source voltage output from first multiplexer 11 times the factor (1+Rf/Rn), where Rn is the resistance value of one of resistors R0, R1 and R7 coupled to the selected output line of multiplexer 12.

Vref2 and V01 are respectively supplied to the inverting and non-inverting inputs of opamp 24 through resistors 26 and 27. The inverting input is further coupled to ground through resistor 52, and the non-inverting input of opamp 24 is coupled to the output thereof through resistor 25. Resistance values of R and R'f are chosen such that the output of opamp 24 is the difference between Vref2 and V01.

Thus, for example, if an 11th gray scale voltage (V11) is to be output, the gradation driving circuit shown in FIG. 5 will subtract a gamma corrected V5 from voltage source V16 and output the difference V11, as a gamma corrected gray scale voltage. In particular, in this case, input data bits D3, D4 and D5 select source voltage V16 by driving output line 02 high, which also closes switch SW'1 in scaling part 13. Further, input data bits D0, D1 and D2 select source voltage V5. Thus, the inverting input of opamp 29 is coupled to output line 02 of second multiplexer 12 through resistor R1, and the non-inverting input of opamp 29 is coupled to source voltage V5. Accordingly, the output of opamp 29 depends on V5(1+Rf/R1). Preferably, Rf and R1 are chosen such that V5 is gamma-corrected. Thus, the output of opamp 29 (V01) is coupled to substraction circuit part 14, which outputs the difference of a gamma corrected V5 from V16(Vref2), so that a gamma corrected V11 is output. If necessary, an inverter can be coupled to the output of opamp 24 to provide a potential having an appropriate polarity.

Alternatively, if gray scale voltage V21 is to be output, source voltage V3 is selected by first multiplexer 11, and supplied unscaled through opamp 29 to subtraction part 14. As a result, source voltage V3 is subtracted from source voltage V24, and the resulting gray scale voltage V21 is output from opamp 24.

Figure 6:
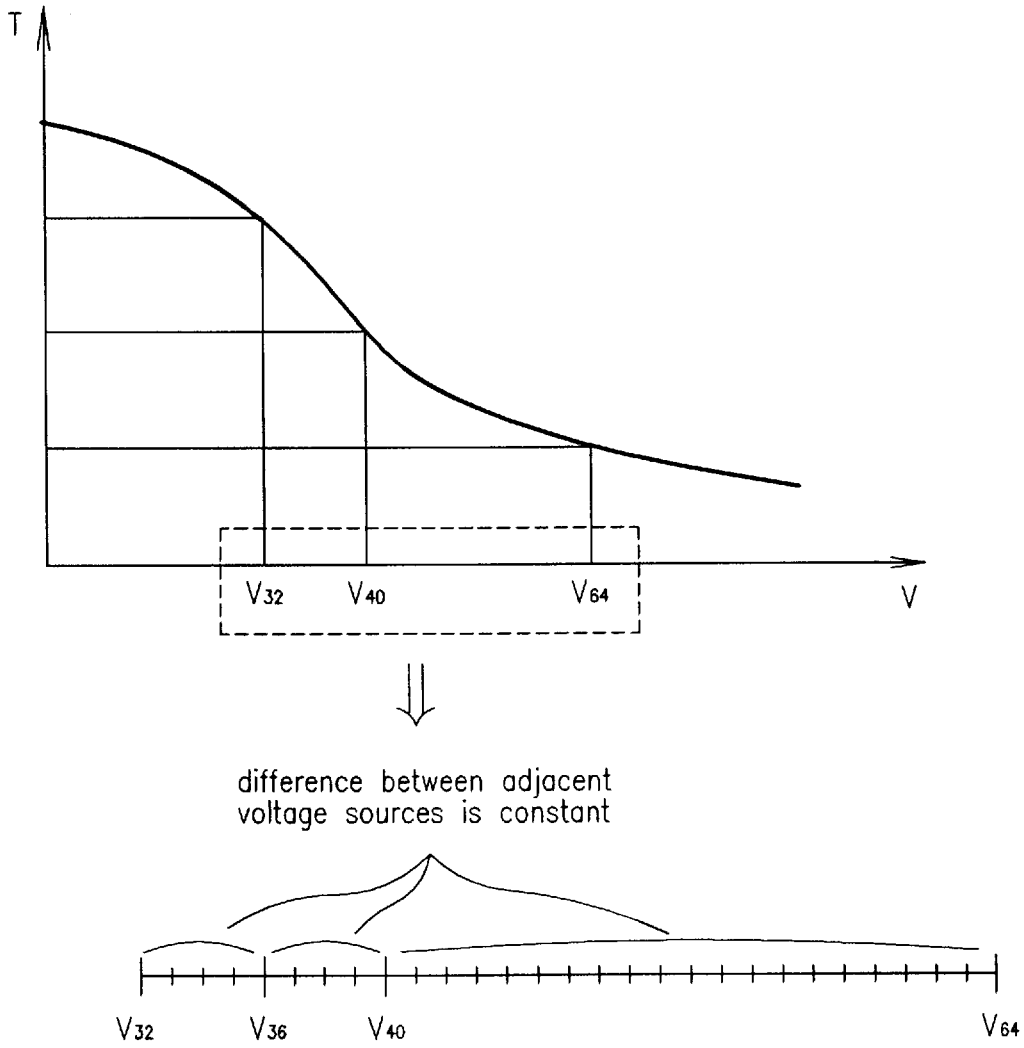
FIG. 6 illustrates the T-V graph of the invention.

FIG. 6 illustrates the T-V curve associated with the present invention. As seen along the abscissa in the graph shown in FIG. 6, the intervals between gray scale voltage values in the range of V36 to V40 are the same but different from the intervals in the range of V40 to V64, thereby more closely approximating the non-linearity of the T-V curve, and providing gamma correction.

Figure 7:
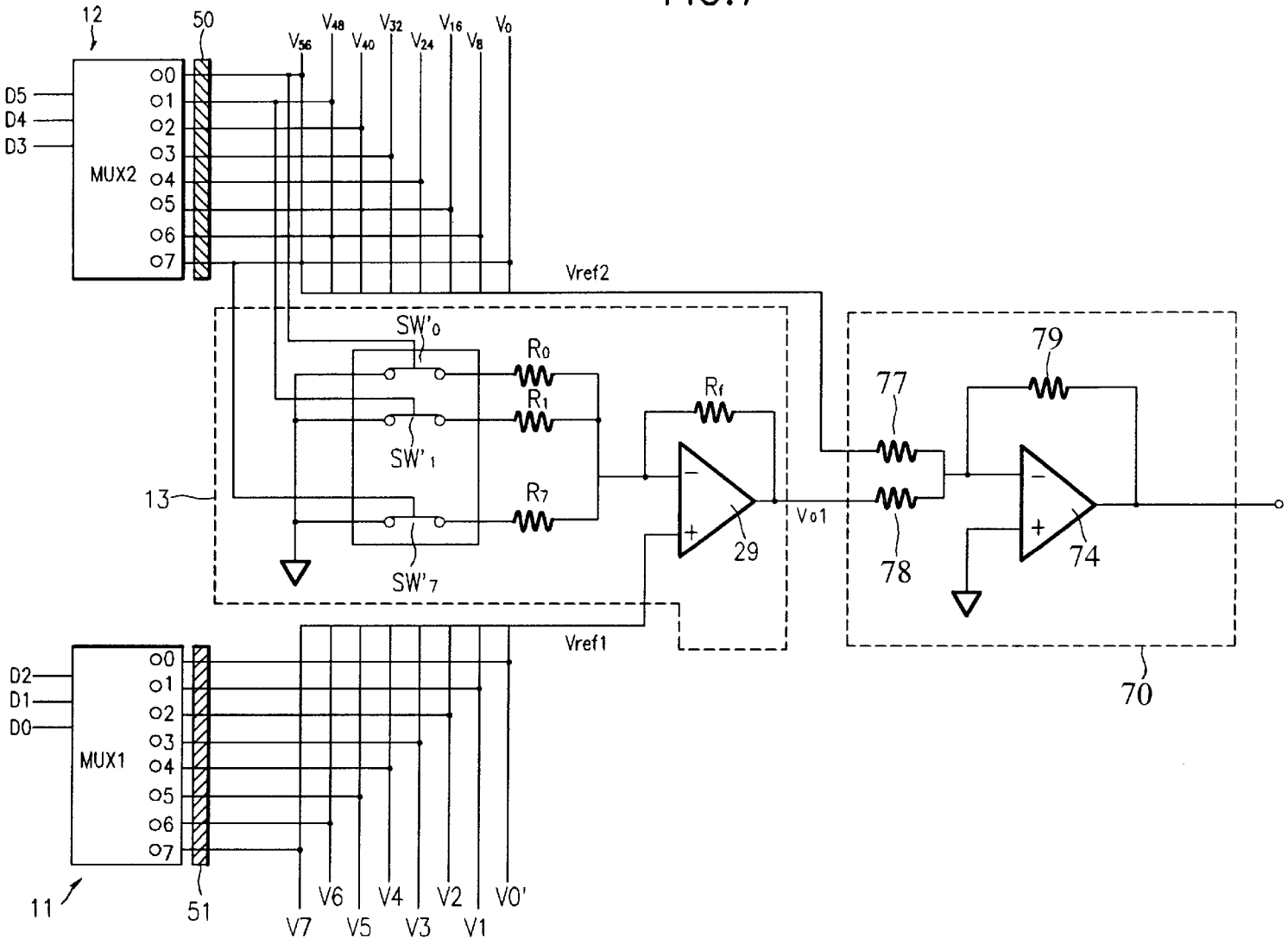
FIG. 7 illustrates a second embodiment in accordance with the present invention.

FIG. 7 illustrates a second embodiment of the present invention whereby voltages selected by the first multiplexer 11 are added to the voltages selected by the second multiplexer 12. The embodiment shown in FIG. 7 is otherwise similar to that shown in FIG. 5.

In accordance with the second embodiment, first and second multiplexers 11 and 12, respectively, select source voltages, and further, scaled or gamma corrected source voltages output from first multiplexer 11 are generated in a similar fashion as that described above. Accordingly, further description of first and second multiplexers 11 and 12, and scaling part 13 will be omitted.

As further shown in FIG. 7, however, an adder circuit 70 receives Vref2 and V01 from second multiplexer 12 and scaling part 13, respectively. Adder circuit 70 preferably includes resistors 77 and 78 which couple these voltages to the inverting input of opamp 74 and to the output thereof through resistor 79. Further, the non-inverting input of opamp 74 is coupled to ground. In this configuration, opamp 74 outputs the sum of V01 and Vref2. If required, an inverter can be coupled to the output of adder circuit 70 to provide the appropriate polarity.

Figure 8:
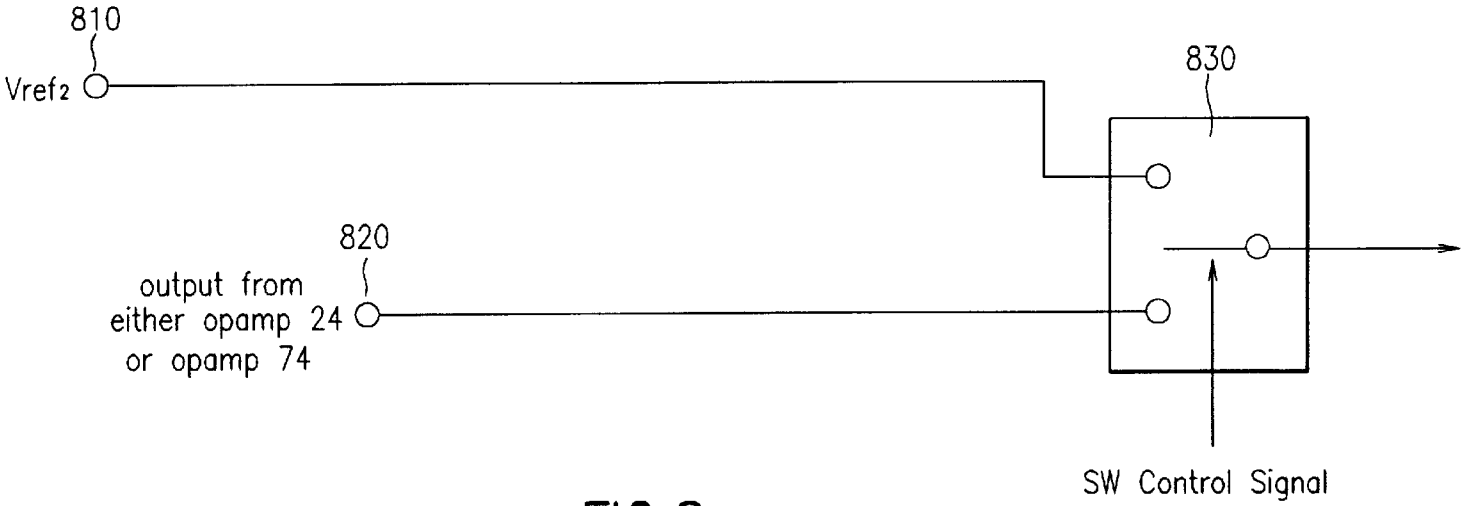
FIG. 8 illustrates an optional circuit in accordance with the present invention.

FIG. 8 illustrates an optional circuit which can be coupled to the output of gradation driving circuits shown in FIGS. 5 and 7. This circuit includes a switch 830 which outputs to Vref2 until a switch control signal SW transfers the switch to output the opamp 24 output (FIG. 25) or opamp 74 output (FIG. 7). It has been found that the scaling circuitry, as well as the adding or subtracting circuits, tend to delay application of the desired voltage to the LCD array. Thus, in order to improve the speed of the gradation driving circuit in accordance with the present invention, the switch circuit shown in FIG. 8 is typically included to initially apply Vref2, the selected source voltage from second multiplexer 12, as a close approximation of the final output from either opamp 24 or opamp 74. The desired output from one of these opamps is then supplied to the LCD array as a more precise gamma corrected gray scale voltage.

Figure 9B:
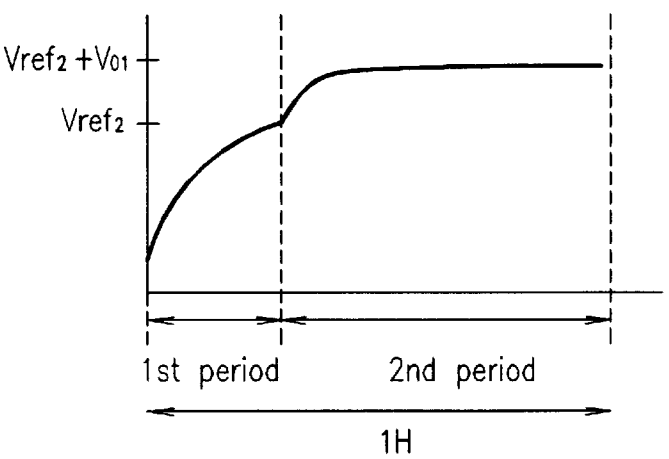
FIGS. 9(*a*) and 9(*b*) illustrates an optional waveforms in accordance with the present invention.
Figure 9A:
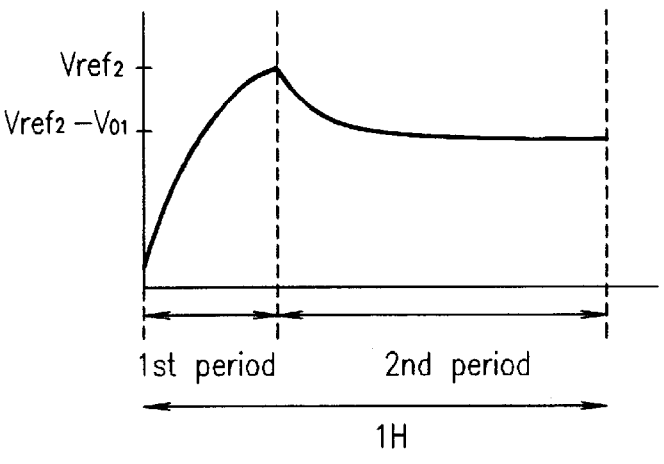

Thus, as shown in FIG. 9*a*, in the event the gradation driving circuit shown in FIG. 5 is used to supply gray-scale voltages to the LCD array, Vref2 is first supplied during a first period of the horizontal synch 1H, followed by application of the difference Vref2−V01 corresponding to the gamma-corrected gray-scale voltage during the second time period. As seen in FIG. 9*b*, if the embodiment shown in FIG. 7 is used, a relatively low Vref2 is initiaily supplied during the first time period, before the gamma corrected gray-scale voltage Vref2+V01 is output during the second time period.

What is claimed is:

1. An electronic circuit for outputting a drive voltage comprising:

a selection circuit configured to receive input data, which includes a plurality of bits, and to output a plurality of source voltages in response to the input data, said selection circuit including a first multiplexor receiving first ones of said plurality of bits; said first multiplexor outputting a first one of said plurality of source voltages in response to the first ones of said plurality of bits;

a scaling circuit coupled to said first multiplexor and adjusting said first one of said plurality of source voltages; and a combining circuit arithmetically combining said adjusted first one of said plurality of source voltages and a second one of said plurality of source voltages to generate said drive voltage.

2. An electronic circuit in accordance with claim 1, wherein said selection circuit further comprises:

a second multiplexer receiving second ones of said plurality of bits, said second multiplexer outputting said second one of said plurality of source voltages.

3. An electronic circuit for outputting a drive voltage comprising:

a selection circuit configured to receive input data, and, in response thereto, outputting a plurality of source voltages;

a scaling circuit coupled to said selection circuit and adjusting a first one of said plurality of source voltages; and a combining circuit arithmetically combining said adjusted first one of said plurality of source voltages and a second one of said plurality of source voltages to generate said drive voltage, wherein said combining circuit generates said drive voltage as a difference between said adjusted first one of said plurality of source voltages and said second one of said plurality of source voltages.

4. An electronic circuit in accordance with claim 3, wherein said combining circuit includes an operational amplifier having first and second inputs, said first input receiving a first potential corresponding to said adjusted first one of said plurality of said source voltages, said second input receiving a second potential corresponding to said second one of said plurality of said source voltages, said operational amplifier further having an output supplying said drive voltage.

5. An electronic circuit for outputting a drive voltage comprising:

a selection circuit configured to receive input data, and, in response thereto, outputting a plurality of source voltages;

a scaling circuit coupled to said selection circuit and adjusting a first one of said plurality of source voltages; and a combining circuit arithmetically combining said adjusted first one of said plurality of source voltages and a second one of said plurality of source voltages to generate said drive voltage, wherein said combining circuit generates said drive voltage as a difference between said adjusted first one of said plurality of source voltages and said second one of said plurality of source voltages, and said combining circuit includes an operational amplifier having first and second inputs, said first input coupled to receive said adjusted first one of said plurality of source voltages and said second one of said plurality of source voltages, and said second input being coupled to a reference potential, said operational amplifier further having an output supplying said drive voltage.

6. An electronic circuit for outputting a drive voltage comprising:

a selection circuit configured to receive input data, and, in response thereto, outputting a plurality of source voltages;

a scaling circuit coupled to said selection circuit and adjusting a first one of said plurality of source voltages; and a combining circuit arithmetically combining said adjusted first one of said plurality of source voltages and a second one of said plurality of source voltages to generate said drive voltage, wherein said scaling circuit includes an operational amplifier configured to output a potential corresponding to said first one of said plurality of source voltages multiplied by a parameter.

7. An electronic circuit for outputting a drive voltage comprising:

a selection circuit configured to receive input data, and, in response thereto, outputting a plurality of source voltages;

a scaling circuit coupled to said selection circuit and adjusting a first one of said plurality of source voltages; and a combining circuit arithmetically combining said adjusted first one of said plurality of source voltages and a second one of said plurality of source voltages to generate said drive voltage, wherein said scaling circuit includes a multiplier circuit multiplying said first one of said plurality of source voltages by a scaling parameter, thereby outputting said adjusted first one of said plurality of source voltages.

8. An electronic circuit in accordance with claim 7, wherein said scaling parameter is selected in accordance with an output from said selection circuit.

9. A gradation driving circuit of a liquid crystal display, comprising:

a first multiplexor selecting a first source voltage in response to first input data;

a second multiplexor selecting a second source voltage in response to second input data;

a scaling circuit multiplying said first source voltage by a scaling parameter to output a scaled first source voltage; and a subtraction circuit configured to receive said scaled first source voltage and said second source voltage and outputting a gray scale voltage corresponding to a difference between said scaled first source voltage and said second source voltage.

10. A gradation driving circuit in accordance with claim 9, wherein said first and second input data collectively constitute a string of bits, said first input data constituting lower order ones of said string of bits, and said second input data constituting higher order ones of said string of bits.

11. A gradation driving circuit in accordance with claim 9, wherein said scaling circuit further comprises:

a switching circuit for selectively supplying an input scaling signal in response to a control signal output from said second multiplexor; and an amplifier circuit outputting said scaled first source voltage in response to said first source voltage and said input scaling signal.

12. A gradation driving circuit in accordance with claim 9, further comprising: a switch circuit coupled to receive said second source voltage and said gray scale voltage, said switch circuit selectively outputting one of said second source voltage and said gray scale voltage in response to a control signal.

13. A gradation driving circuit of a liquid crystal display, comprising:

a first multiplexor selecting a first source voltage in response to first input data;

a second multiplexor selecting a second source voltage in response to second input data;

a scaling circuit multiplying said first source voltage by a scaling parameter to output a scaled first source voltage; and a adding circuit configured to receive said scaled first source voltage and said second source voltage and outputting a gray scale voltage corresponding to a sum of said scaled first source voltage and said second source voltage.

14. A gradation driving circuit in accordance with claim 13, wherein said first and second input data collectively constitute a string of bits, said first input data constituting lower order ones of said string of bits, and said second input data constituting higher order ones of said string of bits.

15. A gradation driving circuit in accordance with claim 13, wherein said scaling circuit further comprises:

a switching circuit for selectively supplying an input scaling signal in response to a control signal output from said second multiplexor; and an amplifier circuit outputting said scaled first source voltage in response to said first source voltage and said input scaling signal.

16. A gradation driving circuit in accordance with claim 13, further comprising: a switch circuit coupled to receive said second source voltage and said gray scale voltage, said switch circuit selectively outputting one of said second source voltage and said gray scale voltage in response to a control signal.

* * * * *